US007882936B2

(12) United States Patent
Murao et al.

(10) Patent No.: US 7,882,936 B2
(45) Date of Patent: Feb. 8, 2011

(54) SHEAVE SUPPORT APPARATUS FOR ELEVATOR

(75) Inventors: Yosuke Murao, Tokyo (JP); Kazuhiro Izumi, Tokyo (JP); Tsutomu Mishiro, Tokyo (JP)

(73) Assignee: Toshiba Elevator Kabushiki Kaisha, Tokyo (JP)

( * ) Notice: Subject to any disclaimer, the term of this patent is extended or adjusted under 35 U.S.C. 154(b) by 119 days.

(21) Appl. No.: 12/120,557

(22) Filed: May 14, 2008

(65) Prior Publication Data

US 2008/0289908 A1 Nov. 27, 2008

(30) Foreign Application Priority Data

May 21, 2007 (JP) ..... 2007-134435

(51) Int. Cl.
*B66B 11/08* (2006.01)
*B66D 1/36* (2006.01)

(52) U.S. Cl. ..... 187/266; 254/286

(58) Field of Classification Search ..... 187/266; 254/265, 266, 283, 286; *B66B 7/00, 7/06, B66B 7/10, 11/08*

See application file for complete search history.

(56) References Cited

U.S. PATENT DOCUMENTS 5,490,577 A * 2/1996 Yoo ..... 187/252
5,957,243 A * 9/1999 Root et al. ..... 187/266
6,640,935 B1 * 11/2003 Murakami et al. ..... 187/401
6,722,475 B2 * 4/2004 Miller et al. ..... 187/266

FOREIGN PATENT DOCUMENTS

JP 2004-189346 A 7/2004
JP 2004359368 A * 12/2004
JP 2007084176 A * 4/2007
JP 2009215051 A * 9/2009

* cited by examiner

*Primary Examiner*—Michael R Mansen
*Assistant Examiner*—Stefan Kruer
(74) *Attorney, Agent, or Firm*—Foley & Lardner LLP

(57) ABSTRACT

A sheave support apparatus for an elevator includes a car frame and a sheave support member. The car frame supports a car, and has a beam extending in a horizontal direction. The sheave support member rotatably supports a pair of sheaves around which cables pass, and is attached to the beam to extend in the horizontal direction in a state of crossing the beam of the car frame. The sheave support member includes a first support beam and a second support beam. The first and the second support beams are fixed to the beam of the car frame in a state of holding the beam therebetween from above and below. The sheaves are supported between respective end portions of the first support beam and respective end portions of the second support beam.

6 Claims, 5 Drawing Sheets

SHEAVE SUPPORT APPARATUS FOR ELEVATOR

CROSS-REFERENCE TO RELATED APPLICATIONS

This application is based upon and claims the benefit of priority from prior Japanese Patent Application No. 2007-134435, filed May 21, 2007, the entire contents of which are incorporated herein by reference.

BACKGROUND OF THE INVENTION

1. Field of the Invention

This invention relates to an elevator having a car which ascends and descends within a shaft, in particular, a structure for firmly fixing sheaves, around which a hoisting cable passes, on a car frame which supports the car.

2. Description of the Related Art

Machine-roomless elevators, which needs no machine room projecting above the shaft, require less space, and have many advantages, such as the building is less influenced by height limitation. For example, in a machine-roomless elevator disclosed in Japanese Patent Publication (KOKAI) No. 2004-189346, a car frame which supports the car is equipped with a pair of sheaves. The sheaves are supported by an upper beam of the car frame through a sheave support beam. A cable from which the car is suspended in the shaft passes around the sheaves.

The sheave support beam is fixed on the lower surface of the upper beam, in the state of being crossed with respect to the upper beam. A bracket is attached to one longitudinal end and the other end of the sheave support beam. The brackets project upward from the sheave support beam. Each sheave is rotatably supported by the brackets, and located on sides of the upper beam.

According to the above structure, the rotational axis line of the sheaves is located above the lower surface of the upper beam, and thus the upper beam can be located as close as possible to the ceiling of the car. Thereby, when the car is hoisted to the uppermost portion of the shaft, the overhead between the uppermost portion of the shaft and the ceiling of the car can be reduced.

According to the sheave support structure disclosed in the above patent publication, the brackets which support the sheaves are only fixed at lower ends on the sheave support beam. In other words, the upper ends of the brackets are free ends which are not bound at all. Therefore, when the sheaves are rotated with raising or lowering of the car, there is the limit for the brackets to firmly support the sheaves. Thus, the position of the sheaves with respect to the sheave support beam easily becomes unstable, and it is inevitable that the sheaves vibrate in the thrust direction. Vibration of the sheaves occurring in raising or lowering of the car causes problems, such as promotion of vibration conducted from the cable to the car through the sheaves and occurrence of noise.

BRIEF SUMMARY OF THE INVENTION

An object of the present invention is to obtain a sheave support apparatus for elevator, which can firmly support sheaves around which a cable is passed, without expanding the space between the beam of the car frame and the car.

To achieve the above object, a sheave support apparatus for elevator comprises:

a car frame supporting a car, the car frame having a beam extending in a horizontal direction; and a sheave support member rotatably supporting a pair of sheaves around which cables pass, the sheave support member being attached to the beam to extend in the horizontal direction in a state of crossing the beam of the car frame.

The sheave support member includes a first support beam and a second support beam. The first and the second support beams are fixed to the beam of the car frame in a state of holding the beam therebetween from above and below. The sheaves are supported between respective end portions of the first support beam and respective end portions of the second support beam.

According to the present invention, the sheaves are firmly supported, and thus it is possible to suppress vibration conducted from the cable to the car through the sheaves and noise.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

A first embodiment of the present invention will be described below with reference to FIGS. 1 and 2.

Figure 1:
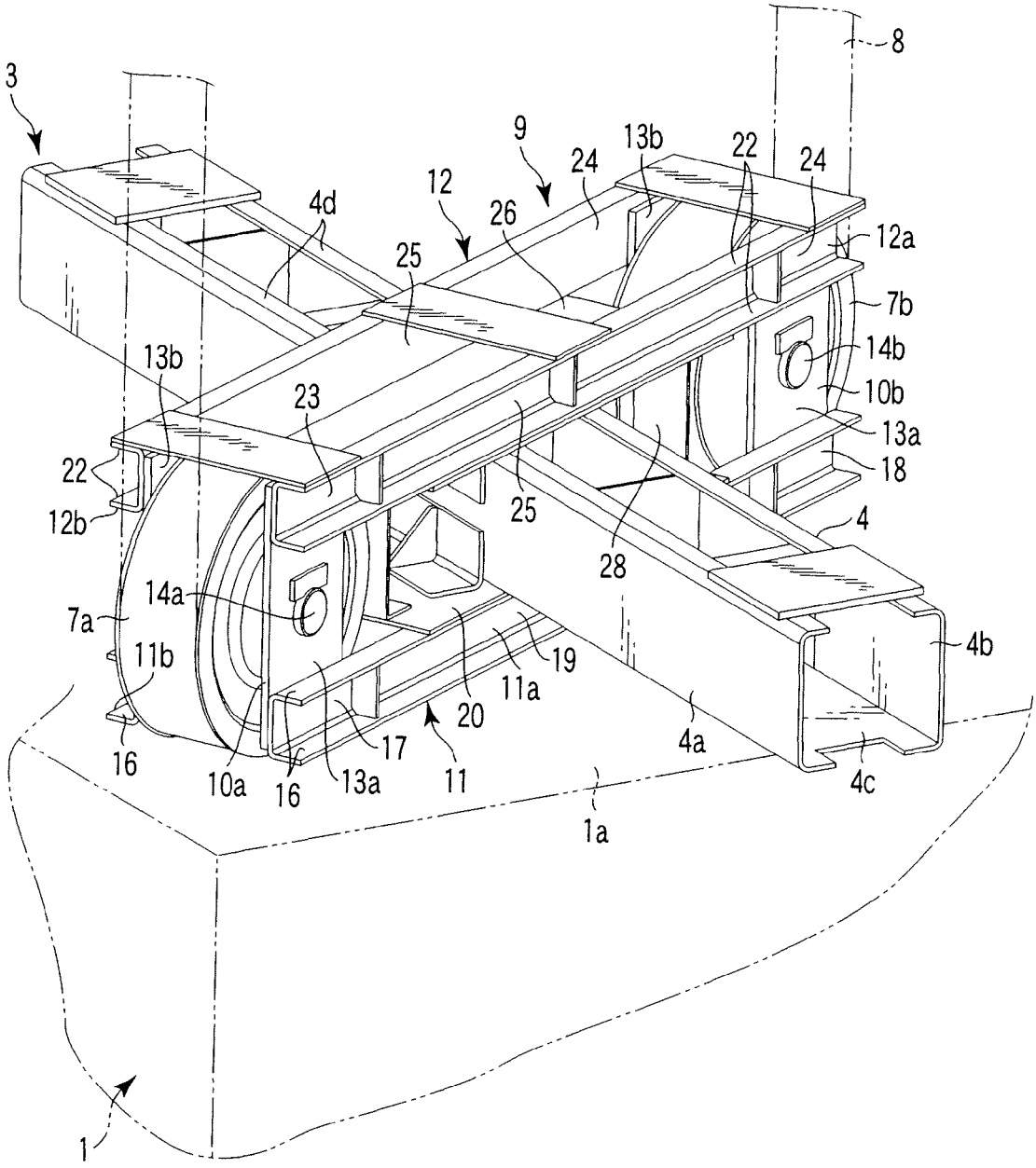
FIG. 1 is a perspective view of a first embodiment of the present invention, illustrating positional relationship between sheaves, a sheave support member, and an upper beam of a car frame.
Figure 2:
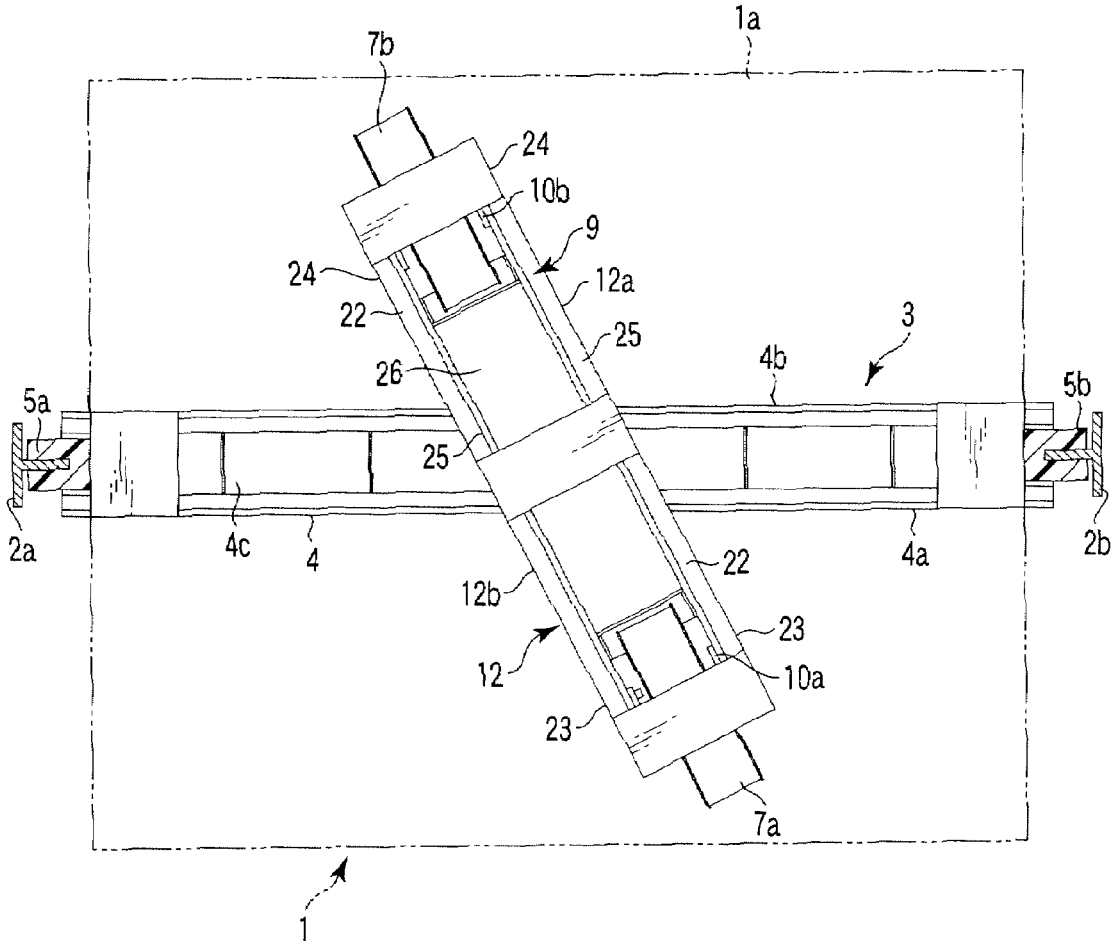
FIG. 2 is a plan view of the first embodiment of the present invention, illustrating positional relationship between the sheaves, the sheave support member, and the upper beam of the car frame.

In FIGS. 1 and 2, reference numeral 1 denotes a car for a machine-roomless elevator. The car 1 has a rectangular box shape having a ceiling 1*a*. The car 1 is located in a shaft of a building (not shown), and ascends and descends within the shaft along a pair of guide rails 2*a* and 2*b* provided in the shaft.

As illustrated in FIG. 1, a car frame 3 which supports the car 1 has an upper beam 4. The upper beam 4 has a rectangular tubular shape having a pair of side plates 4*a* and 4*b* and a bottom plate 4*c*. A reinforcing portion 4*d* which is bent like a flange is formed on each of upper edges of the side plates 4*a* and 4*b* of the upper beam 4. The upper beam 4 is located directly on the car 1, and horizontally extends along the side-to-side direction to spread between the guide rails 2*a* and 2*b*. A guide shoe 5*a* which is slidably engaged with the guide rail 2*a* is attached to the left end portion of the upper beam 4. In the same manner, a guide shoe 5*b* which is slidably engaged with the guide rail 2*b* is attached to the right end portion of the upper beam 4.

As illustrated in FIG. 1, a pair of sheaves 7*a* and 7*b* are arranged on the upper portion of the car 1. The sheaves 7*a* and 7*b* are arranged away from each other in the front-to-back direction of the car 1, with the upper beam 4 interposed therebetween. A plurality of cables 8 are passed around (and hung) on the sheaves 7*a* and 7*b*. The car 1 is suspended in the shaft by the cables 8.

The sheaves 7*a* and 7*b* are supported by the upper beam 4 of the car frame 3 through a sheave support member 9. The sheave support member 9 has a pair of bearing portions 10*a* and 10*b*, a first support beam 11, and a second support beam 12.

Each of the bearing portions 10*a* and 10*b* has a pair of brackets 13*a* and 13*b*. The brackets 13*a* and 13*b* have a flat shape, and are opposed to each other with an interval. The sheave 7*a* is interposed between the brackets 13*a* and 13*b* of the bearing portion 10*a*, and rotatably supported by the brackets 13*a* and 13*b* through a support shaft 14*a*. In the same manner, the sheave 7*b* is interposed between the brackets 13*a* and 13*b* of the bearing portion 10*b*, and rotatably supported by the brackets 13*a* and 13*b* through a support shaft 14*b*.

The first support beam 11 extends in the horizontal direction between the ceiling 1*a* of the car 1 and the upper beam 4. Further, the first support beam 11 runs under and crosses the upper beam 4. The first beam 11 has a pair of beam forming members 11*a* and 11*b*. Each of the beam forming members 11*a* and 11*b* is formed of shaped steel having a groove shape and having reinforcing portions 16*a*, which are bent like a flange, at its upper and lower ends. The beam forming members 11*a* and 11*b* extend in a straight manner in a direction crossing the upper beam 4.

Each of the beam forming members 11*a* and 11*b* has a first end portion 17, a second end portion 18, and an intermediate portion 19. Each first end portion 17 is provided in a position corresponding to one sheave 7*a*. Each second end portion 18 is provided in a position corresponding to the other sheave 7*b*. Each intermediate portion 19 is located between the relevant first end portion 17 and the second end portion 18.

The first end portions 17 of the beam forming members 11*a* and 11*b* are fixed on lower end portions of the brackets 13*a* and 13*b* of the bearing portion 10*a*, respectively, by means such as bolts or welding. In the same manner, the second end portions 18 of the beam forming members 11*a* and 11*b* are fixed to lower end portions of the brackets 13*a* and 13*b* of the bearing portion 10*b*, respectively, by means such as bolts or welding. Therefore, the beam forming members 11*a* and 11*b* are arranged in parallel away from each other.

The fixing portion in which the first end portions 17 of the beam forming members 11*a* and 11*b* contact the brackets 13*a* and 13*b*, respectively, is located below the support shaft 14*a*, which serves as the rotational center of the sheave 7*a*. In the same manner, the fixing portion in which the second end portions 18 of the beam forming members 11*a* and 11*b* contact the brackets 13*a* and 13*b*, respectively, is located below the support shaft 14*b*, which serves as the rotational center of the sheave 7*b*.

The intermediate portions 19 of the beam forming members 11*a* and 11*b* are connected to each other by a flat connecting plate 20. The connecting plate 20 is fixed to the intermediate portions 19 of the beam forming members 11*a* and 11*b* by means such as bolts or welding.

The second support beam 12 runs and crosses over the upper beam 4. The second support beam 12 has a pair of beam forming members 12*a* and 12*b*. Each of the beam forming members 12*a* and 12*b* is formed of shaped steel having a groove shape and having reinforcing portions 22, which are bent like a flange, at its upper and lower ends. The beam forming members 12*a* and 12*b* extend in a straight manner in a direction crossing the upper beam 4.

Each of the beam forming members 12*a* and 12*b* has a first end portion 23, a second end portion 24, and an intermediate portion 25. Each first end portion 23 is provided in a position corresponding to one sheave 7*a*. Each second end portion 24 is provided in a position corresponding to the other sheave 7*b*. Each intermediate portion 25 is located between the relevant first end portion 23 and the second end portion 24.

The first end portions 23 of the beam forming members 12*a* and 12*b* are fixed on upper end portions of the brackets 13*a* and 13*b* of the bearing portion 10*a*, respectively, by means such as bolts or welding. In the same manner, the second end portions 24 of the beam forming members 12*a* and 12*b* are fixed to upper end portions of the brackets 13*a* and 13*b* of the bearing portion 10*b*, respectively, by means such as bolts or welding. Therefore, the beam forming members 12*a* and 12*b* are arranged in parallel away from each other.

The fixing portion in which the first end portions 23 of the beam forming members 12*a* and 12*b* contact the brackets 13*a* and 13*b*, respectively, is located above the support shaft 14*a*, which serves as the rotational center of the sheave 7*a*. In the same manner, the fixing portion in which the second end portions 24 of the beam forming members 12*a* and 12*b* contact the brackets 13*a* and 13*b*, respectively, is located above the support shaft 14*b*, which serves as the rotational center of the sheave 7*b*.

The intermediate portions 25 of the beam forming members 12*a* and 12*b* are connected to each other by a flat connecting plate 26. The connecting plate 26 is fixed to the intermediate portions 25 of the beam forming members 12*a* and 12*b* by means such as bolts or welding.

Therefore, the brackets 13*a* and 13*b* which support one sheave 7*a* are supported between the first end portions 17 of the beam forming members 11*a* and 11*b* and the first end portions 23 of the beam forming members 12*a* and 12*b*. In the same manner, the brackets 13*a* and 13*b* which support the other sheave 7*b* are supported between the second end portions 18 of the beam forming members 11*a* and 11*b* and the second end portions 24 of the beam forming members 12*a* and 12*b*. Therefore, each of the bearing portions 10*a* and 10*b* is supported by the four beam forming members 11*a*, 11*b*, 12*a* and 12*b*.

As illustrated in FIG. 1, a space 28 is formed between the connecting plate 20 of the first support beam 11 and the connecting plate 26 of the second support beam 12. The space 28 is located between the sheaves 7*a* and 7*b*. The connecting plate 20 of the first support beam 11 defines the lower end of the space 28. The connecting plate 26 of the second support beam 12 defines the upper end of the space 28.

The connecting plate 20 of the first support beam 11 is superposed on the bottom plate 4*c* of the upper beam 4, and fixed on the bottom plate 4*c* by means such as bolts or welding. The connecting plate 26 of the second support beam 12 is superposed on the flange-shaped reinforcing portions 4*d* located on the upper edge of the upper beam 4, and fixed on the reinforcing portions 4*d* by means such as bolts and welding.

Therefore, the first support beam 11 and the second support beam 12 are firmly fixed onto the upper beam 4, in the state of holding the upper beam 4 therebetween from above and below. By this fixing, the upper beam 4 is laid in the space 28, and the upper beam 4 and the sheave support member 9 form a unitary structure. Further, the rotational centers of the sheaves 7*a* and 7*b* are located within the range of the height of the upper beam 4.

According to the first embodiment having the above structure, the sheaves 7*a* and 7*b* are supported by the first support beam 11 which spreads between the lower end portions of the bearing portions 10*a* and 10*b*, and the second support beam 12 which spreads between the upper end portions of the bearing portions 10*a* and 10*b*. In addition, the first and the second support beams 11 and 12 are fixed onto the upper beam 4, in the state of holding the upper beam 4 therebetween from above and below between the sheaves 7*a* and 7*b*.

Therefore, the sheaves 7*a* and 7*b* are located on sides of the upper beam 4 of the car frame 3, and do not widely project from the upper beam 4 toward the ceiling 1*a* of the car 1. Thus, the upper beam 4 can be located close to the ceiling 1*a* of the car 1, and unnecessary space between the upper beam 4 and the car 1 can be eliminated. As a result, it is possible to reduce the overhead generated between the uppermost portion of the shaft and the ceiling 1*a* of the car 1 when the car 1 is hoisted to the uppermost portion of the shaft.

Further, the first support beam 11 is fixed to the lower end portions of the bearing portions 10*a* and 10*b* which support the sheaves 7*a* and 7*b*, and the second support beam 12 is fixed to the upper end portions of the bearing portions 10*a* and 10*b* which support the sheaves 7*a* and 7*b*. Consequently, the bearing portions 10*a* and 10*b* are supported in two positions, that is, the upper end and the lower end which hold the support shaft 14 therebetween, and the sheaves 7*a* and 7*b* can be firmly supported between the first support beam 11 and the second support beam 12.

Thus, vibration of the sheaves 7*a* and 7*b* in the thrust direction is restricted, and vibration conducted from the cables 8 to the car 1 through the sheaves 7*a* and 7*b* and noise can be suppressed.

In addition, the first support beam 11 is formed of a pair of beam forming members 11*a* and 11*b*, and the second support beam 12 is formed of a pair of beam support members 12*a* and 12*b*. This means that, in the first embodiment, the four beam forming members 11*a*, 11*b*, 12*a*, and 12*b* support the sheaves 7*a* and 7*b*. As a result, the section modulus of the individual beam forming members 11*a*, 11*b*, 12*a*, and 12*b* can be reduced, and the height of each of the beam forming members 11*a*, 11*b*, 12*a*, and 12*b* can be reduced.

Therefore, it is possible to reduce the height of the sheave support member 9, while vibration of the sheaves 7*a* and 7*b* is suppressed by firmly supporting the sheaves 7*a* and 7*b*.

The present invention is not limited to the above first embodiment, but can be carried out with various modifications within the range not departing from the gist of the invention.

Figure 3:
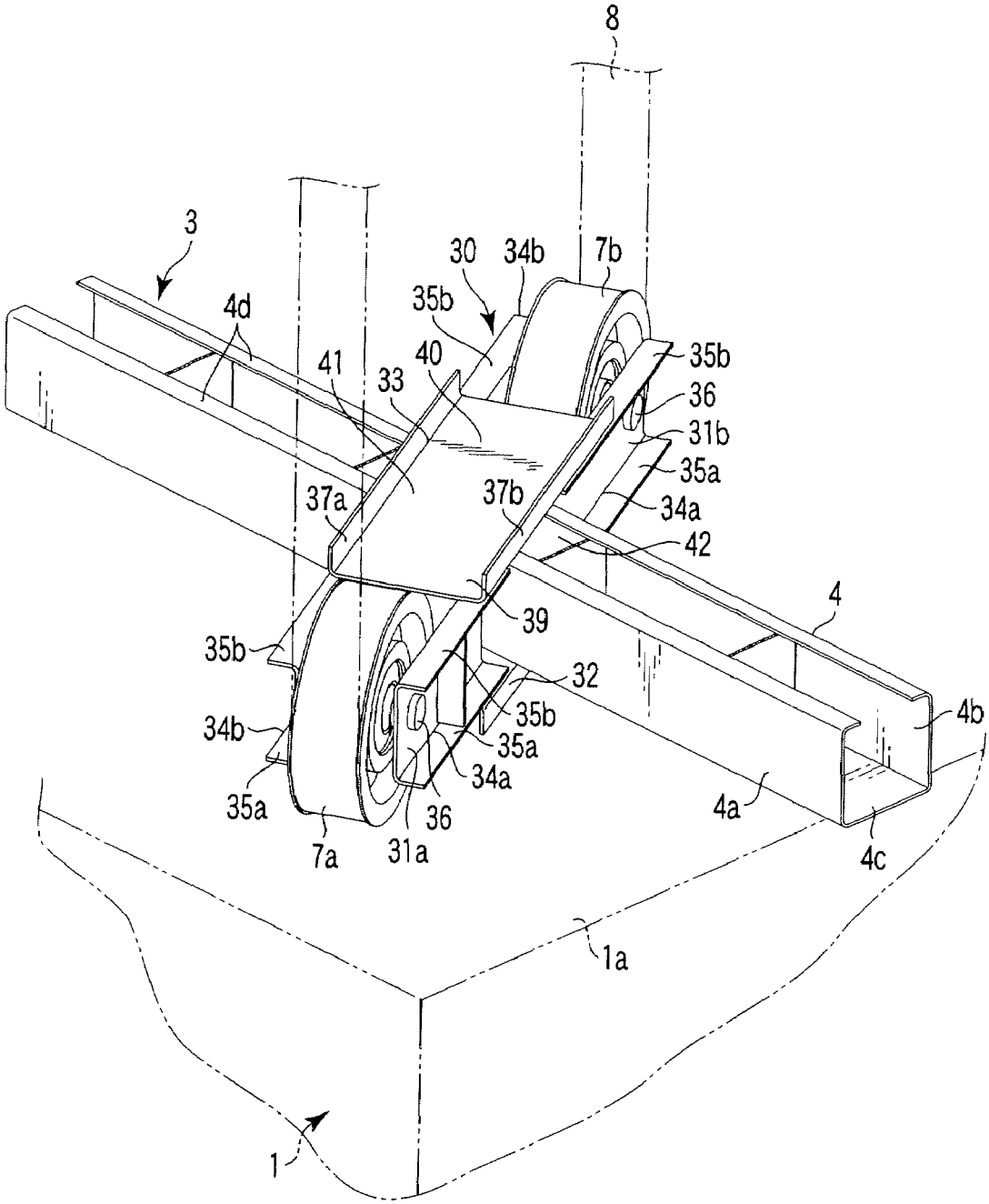
FIG. 3 is a perspective view of a second embodiment of the present invention, illustrating positional relationship between sheaves, a sheave support member, and an upper beam of a car frame.

FIG. 3 discloses a second embodiment of the present invention. The second embodiment is different from the first embodiment in the structure of a sheave support member 30, and the same as the first embodiment in other constituent elements. Therefore, constituent elements of the second embodiment which are the same as those of the first embodiment are denoted by the same respective reference numerals, and explanations thereof are omitted.

As illustrated in FIG. 3, the sheave support member 30 has a pair of bearing portions 31*a* and 31*b*, a first support beam 32, and a second support beam 33.

Each of the bearing portions 31*a* and 31*b* has a pair of brackets 34*a* and 34*b*. Each of the brackets 34*a* and 34*b* is formed of shaped steel having a groove shape. Each of the brackets 34*a* and 35*b* has a first reinforcing portion 35*a* and a second reinforcing portion 35*b*. The first reinforcing portions 35*a* are located in lower ends of the brackets 34*a* and 34*b*, and project from the lower ends like a flange. The second reinforcing portions 35*b* are located in upper ends of the brackets 34*a* and 34*b*, and project from the upper ends like a flange. The brackets 34*a* and 34*b* are opposed to each other, with the sheave 7*a* or 7*b* interposed therebetween. The sheaves 7*a* and 7*b* are interposed between the relevant brackets 34*a* and 34*b*, and rotatably supported by the brackets 34*a* and 34*b* through a support shaft 36.

The first and second support beams 32 and 33 have the same shape, and thus the second support beam 33 which runs over the upper beam 4 is explained as a representative. As illustrated in FIG. 3, the second support beam 33 has a flat shape having a width spreading between the brackets 34*a* and 34*b*, and extends in a straight manner along a direction crossing the upper beam 4. A flange-shaped reinforcing portion 37*a* is formed on one side edge of the second support beam 33. A flange-shaped reinforcing portion 37*b* is formed on the other side edge of the second support beam 33. The reinforcing portions 37*a* and 37*b* are bent at right angles to the second support beam 33.

The second support beam 33 has a first end portion 39, a second end portion 40, and an intermediate portion 41. The first end portion 39 is provided in a position adjacent to one sheave 7*a*. The second end portion 40 is provided in a position adjacent to the other sheave 7*b*. The intermediate portion 41 is located between the first end portion 39 and the second end portion 40.

The first end portion 39 of the second support beam 33 is fixed on the second reinforcing portions 35*b* located on the upper ends of the brackets 34*a* and 34*b* of the bearing portion 31*a* by means such as bolts or welding. In the same manner, the second end portion 40 of the second support beam 33 is fixed on the second reinforcing portions 35*b* located on the upper ends of the brackets 34*a* and 34*b* of the bearing portion 31*b* by means such as bolts or welding.

Therefore, the second support beam 33 spreads between the bearing portions 31*a* and 31*b*, and connects the upper ends of the bearing portions 31*a* and 31*b*.

The first support beam 32 is disposed between the bottom plate 4*c* of the upper beam 4 and the ceiling 1*a* of the car 1. The first support beam 32 spreads between the bearing portions 31*a* and 31*b*, and connects lower ends of the bearing portions 31*a* and 31*b*.

As illustrated in FIG. 3, a space 42 is formed between the intermediate portion 41 of the first support beam 32 and the intermediate portion 41 of the second support beam 33. The space 42 is located between the sheaves 7*a* and 7*b*. The intermediate portion 41 of the first support beam 32 defines the lower end of the space 42. The intermediate portion 41 of the second support beam 33 defines the upper end of the space 42.

An intermediate portion 41 of the first support beam 32 is superposed on the bottom plate 4*c* of the upper beam 4, and fixed onto the bottom plate 4*c* by means such as bolts or welding. The intermediate portion 41 of the second support beam 33 is superposed on reinforcing portions 4*d* located at upper edges of the upper beam 4, and fixed onto the reinforcing portions 4*d* by means such as bolts or welding.

Therefore, the first support beam 32 and the second support beam 33 are firmly fixed to the upper beam 4, in a state of holding the upper beam 4 therebetween from above and below. By this fixing, the upper beam 4 is laid in the space 42, and the upper beam 4 and the sheave support member 30 form a unitary structure. Further, the rotational centers of the sheaves 7*a* and 7*b* are located within a range of the height of the upper beam 4.

According to the second embodiment, each of the brackets 34*a* and 34*b* supporting the sheaves 7*a* and 7*b* has the first and second reinforcing portions 35*a* and 35*b* having a flange shape, and thus the strength thereof is sufficiently ensured. Further, the lower ends of the brackets 34*a* and 34*b* are connected by the first support beam 32, and the upper ends of the brackets 34*a* and 34*b* are connected by the second support beam 33. Therefore, the sheaves 7*a* and 7*b* can be more firmly supported between the brackets 34*a* and 34*b*, and vibration of the sheaves 7*a* and 7*b* can be suppressed with reliability.

Figure 4:
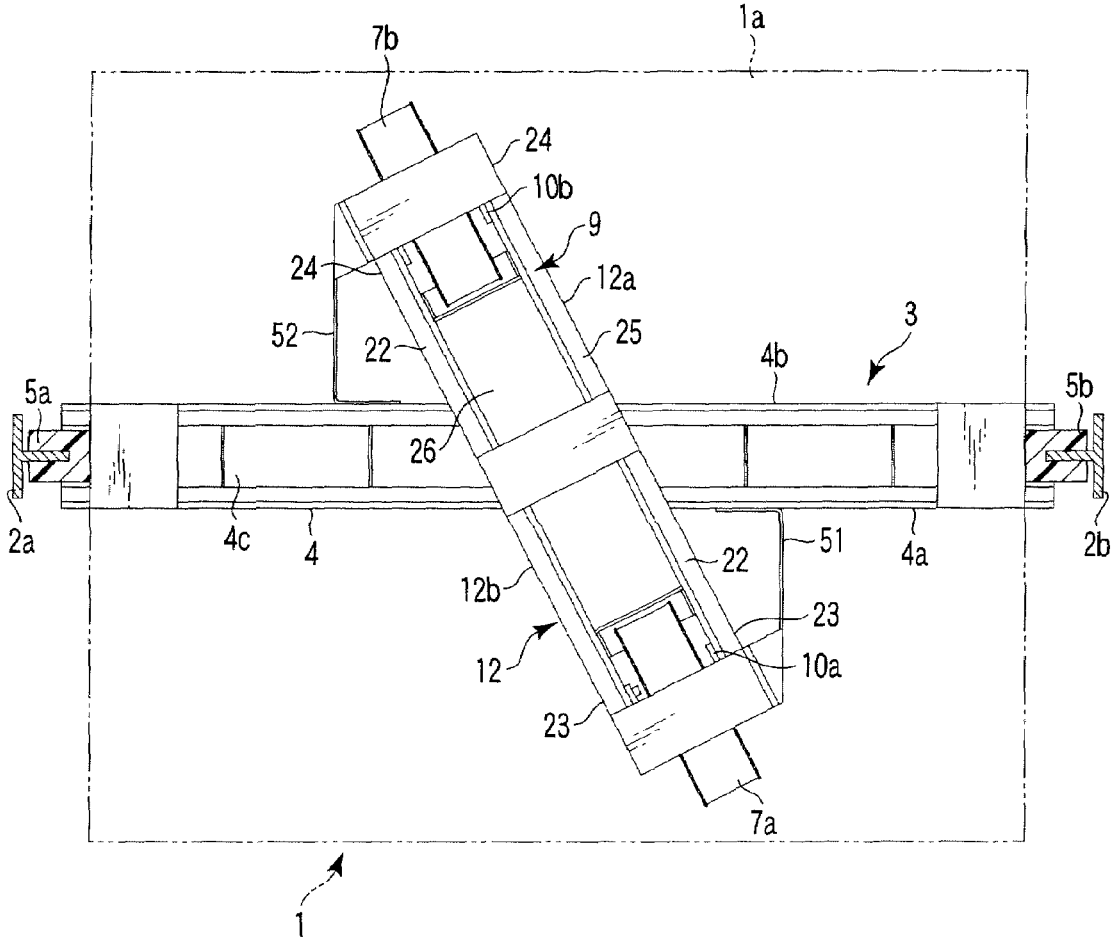
FIG. 4 is a plan view of a third embodiment of the present invention, illustrating positional relationship between a sheave support member, an upper beam of a car frame, a first connecting member, and a second connecting member.

FIG. 4 discloses a third embodiment of the present invention.

The third embodiment is developed from the first embodiment, and the basic structure of the upper beam 4 and the sheave support member 9 thereof is the same as that of the first embodiment.

FIG. 4 is a plan view illustrating positional relationship between the upper beam 4 of the car frame 3 and the sheave support member 9. Therefore, the first support beam 11 located under the second support beam 12 is covered with the second support beam 12 from above, and not shown in FIG. 4.

In the third embodiment illustrated in FIG. 4, a first connecting member 51 spans between first end portions 17 and 23 of the first and second support beams 11 and 12 and one side plate 4*a* of the upper beam 4. In the same manner, a second connecting member 52 spans between second end portions 18 and 24 of the first and second support beams 11 and 12 and the other side plate 4*b* of the upper beam 4.

One end of the first connecting member 51 is connected to the first and second support beams 11 and 12 by means such as bolts and welding. The other end of the first connecting member 51 is connected to one side plate 4*a* of the upper beam 4 by means such as bolts or welding. In the third embodiment, the first connecting member 51 is connected to the upper beam 4 perpendicularly to the upper beam 4.

One end of the second connecting member 52 is connected to the first and second support beams 11 and 12 by means such as bolts or welding. The other end of the second connecting member 52 is connected to the other side plate 4*b* of the upper beam 4 by means such as bolts or welding. In the third embodiment, the second connecting member 52 is connected to the upper beam 4 perpendicularly to the upper beam 4.

According to the third embodiment having the above structure, the bearing portion 10*a* of the sheave support member 9 can be supported by the first connecting member 51. In the same manner, the bearing portion 10*b* of the sheave support member 9 can be supported by the second connecting member 52. Therefore, free movement of the bearing portions 10*a* and 10*b* of the sheave support member 9 can be restrained by the first and second connecting members 51 and 52, and thus the sheaves 7*a* and 7*b* can be more firmly supported.

Figure 5:
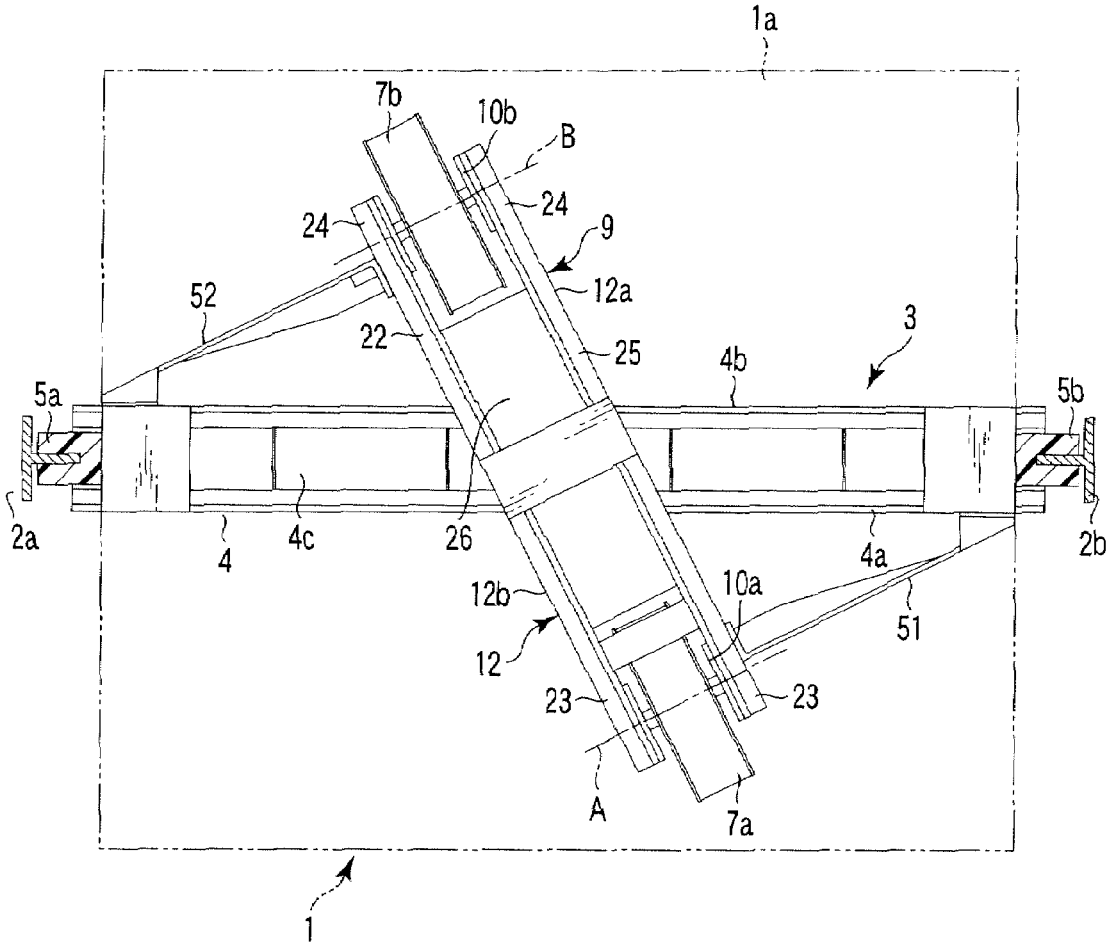
FIG. 5 is a plan view of a fourth embodiment of the present invention, illustrating positional relationship between a sheave support member, an upper beam of a car frame, a first connecting member, and a second connecting member.

FIG. 5 discloses a fourth embodiment of the present invention.

The fourth embodiment is a further development of the above third embodiment, and the basic structure of the upper beam 4, the sheave support member 9, the first connecting member 51 and the second connecting member 52 is the same as that of the third embodiment.

FIG. 5 is a plan view illustrating positional relationship between the upper beam 4 of the car frame 3 and the sheave support member 9. Therefore, the first support beam 11 located under the second support beam 12 is covered with the second support beam 12 from above, and not shown in FIG. 5.

According to the fourth embodiment, the first connecting member 51 is connected to the first and second support beams 11 and 12 to be perpendicular to the first end portions 17 and 23 of the first and second support beams 11 and 12. In the same manner, the second connecting member 52 is connected to the first and second support beams 11 and 12 to be perpendicular to the second end portions 18 and 24 of the first and second support beams 11 and 12.

Therefore, as illustrated in FIG. 5, when the upper beam 4 and the sheave support member 9 are viewed in a planar manner, the first connecting member 51 extends in a straight manner along the rotational axis line A of the sheave 7*a*, and the second connecting member 52 extends in a straight manner along the rotational axis line B of the sheave 7*b*. Therefore, the first connecting member 51 supports the bearing portion 10*a* of the sheave support member 9 in the axial direction of the sheave 7*a*. In the same manner, the second connecting member 52 supports the bearing portion 10*b* of the sheave support member 9 in the axial direction of the sheave 7*b*.

According to the fourth embodiment having the above structure, free movement of the bearing portions 10*a* and 10*b* of the sheave support member 9 can be restrained by the first and second connecting members 51 and 52. In addition, the first and second connecting members 51 and 52 are located between the upper beam 4 and the sheave support member 9 in such a manner as to extend along the rotational axis lines A and B of the sheaves 7*a* and 7*b*. Therefore, the vibration in the thrust direction of the sheaves 7*a* and 7*b* can be suppressed by the first and second connecting members 51 and 52. Thus, the sheaves 7*a* and 7*b* can be more firmly supported.

When the present invention is carried out, the bearing portions 10*a* and 10*b* of the sheave support member 9 may be supported by using, for example, both the first and second connecting members 51 and 52 illustrated in FIG. 4 and the first and second connecting members 51 and 52 illustrated in FIG. 5. Thereby, the sheaves 7*a* and 7*b* can be more firmly supported.

Although the sheaves are arranged on the upper portion of the car in the above embodiments, the present invention is not limited to it. For example, the present invention can be carried out in the same manner, also for elevators in which sheaves are arranged on the bottom portion of the car.

Further, the sheave support apparatus according to the present invention is not limited to use for machine-roomless elevators, but is also applicable to elevators of a type in which a machine room is provided at the upper end of the shaft.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A sheave support apparatus for an elevator, comprising:

a car frame supporting a car, the car frame having a beam extending in a horizontal direction; and a sheave support member being attached to the beam in a state of crossing the beam of the car frame and extending in a horizontal direction, the sheave support member including a first support beam and a second support beam which are fixed to the beam of the car frame and vertically hold therebetween the beam of the car frame; and a pair of sheaves supported between respective end portions of the first support beam and respective end portions of the second support beam and around which cables are partly wound, wherein the sheaves are rotatably supported between a pair of brackets through support shafts, and the end portions of the first support beam and the end portions of the second support beams are fixed to the brackets, and wherein the first support beam and the second support beam each include a pair of beam forming members which are arranged in parallel with each other with the sheaves interposed therebetween, the beam forming members of the first support beam are fixed to the brackets below rotational centers of the sheaves and below the beam of the car frame, and the beam forming members of the second support beam are fixed to the brackets above the rotational centers of the sheaves and above the beam of the car frame.

2. A sheave support apparatus according to claim 1, wherein the support shafts are located between a fixing portion in which the brackets contact the first support beam and a fixing portion in which the brackets contact the second support beam.

3. A sheave support apparatus according to claim 1, wherein each of the brackets has a reinforcing portion.

4. A sheave support apparatus according to claim 1, wherein the sheave support member has a first end portion in which one sheave is located and a second end portion in which the other sheave is located, the first end portion of the sheave support member is connected to the beam of the car frame by a first connecting member, and the second end portion of the sheave support member is connected to the beam of the car frame by a second connecting member.

5. A sheave support apparatus according to claim 4, wherein the first connecting member and the second connecting member are connected to the beam of the car frame to be perpendicular to the beam.

6. A sheave support apparatus according to claim 4, wherein the first connecting member and the second connecting member are interposed between the sheave support member and the beam of the car frame to run along a rotational axis line of the relevant sheave.

* * * * *